US007090732B2

(12) United States Patent
Usami et al.

(10) Patent No.: US 7,090,732 B2
(45) Date of Patent: Aug. 15, 2006

(54) HIGH-MECHANICAL STRENGTH COPPER ALLOY

(75) Inventors: Takayuki Usami, Tokyo (JP); Takao Hirai, Tokyo (JP)

(73) Assignee: The Furukawa Electric, Co., Ltd., Tokyo (JP)

( * ) Notice: Subject to any disclaimer, the term of this patent is extended or adjusted under 35 U.S.C. 154(b) by 406 days.

(21) Appl. No.: 10/602,646

(22) Filed: Jun. 25, 2003

(65) Prior Publication Data

US 2004/0045640 A1 Mar. 11, 2004

Related U.S. Application Data

(63) Continuation-in-part of application No. 09/966,389, filed on Sep. 27, 2001, now Pat. No. 6,893,514.

(30) Foreign Application Priority Data

Dec. 15, 2000 (JP) ..... 2000-381863

(51) Int. Cl.
*C22C 9/06* (2006.01)

(52) U.S. Cl. ..... 148/433; 420/476

(58) Field of Classification Search ..... 148/433; 420/476

See application file for complete search history.

(56) References Cited

U.S. PATENT DOCUMENTS

| | | | | |
|---|---|---|---|---|
| 4,362,579 | A | 12/1982 | Tsuji | 148/11.5 |
| 4,425,168 | A | 1/1984 | Goldstein et al. | |
| 4,594,221 | A | 6/1986 | Caron et al. | 420/485 |
| 4,612,167 | A | 9/1986 | Watanabe et al. | 420/471 |
| 4,656,003 | A | 4/1987 | Miyafuji et al. | 420/473 |
| 4,687,633 | A | 8/1987 | Miyafuji et al. | 420/481 |
| 4,728,372 | A | 3/1988 | Caron et al. | 148/2 |
| 4,877,577 | A | 10/1989 | Futatsuka et al. | 420/473 |
| 5,028,391 | A | 7/1991 | Ingerson | 420/488 |
| 5,334,346 | A | 8/1994 | Kim et al. | 420/4.85 |
| 5,463,247 | A | 10/1995 | Futatsuka et al. | 257/666 |
| 5,508,001 | A | 4/1996 | Suzuki et al. | |
| 5,675,883 | A | 10/1997 | Gaag et al. | |
| 5,833,920 | A | 11/1998 | Nakanishi et al. | 420/477 |
| 5,846,346 | A | 12/1998 | Lee et al. | 148/433 |
| 5,997,810 | A | 12/1999 | Futatsuka et al. | |
| 6,040,067 | A | 3/2000 | Sugawara et al. | 428/647 |
| 2002/0119071 | A1 | 8/2002 | Usami et al. | |

(Continued)

FOREIGN PATENT DOCUMENTS

| | | |
|---|---|---|
| EP | 0 440 548 | 8/1991 |

(Continued)

OTHER PUBLICATIONS

Taiwanese Office Action dated Nov. 13, 2002, for a corresponding Taiwan application of U.S. Appl. No. 10/005,880, w/English translation.

(Continued)

*Primary Examiner*—Sikyin Ip
(74) *Attorney, Agent, or Firm*—Westerman, Hattori, Daniels & Adrian, LLP

(57) ABSTRACT

A high-mechanical strength copper alloy, which comprises Ni 1.0 to 4.5% by mass, Si 0.2 to 1.0% by mass, Mg 0.01 to 0.20% by mass, Sn 0.05 to 1.5% by mass, Zn 0.2 to 1.5% by mass, and S less than 0.005% by mass (including 0% by mass), with the balance being made of Cu and inevitable impurities, wherein the alloy has a tensile strength of 800 $N/mm^2$ or more, and wherein the alloy has a stress relaxation ratio of 10% or less.

38 Claims, 2 Drawing Sheets

U.S. PATENT DOCUMENTS

| | | | |
|---|---|---|---|
| 2002/0127133 | A1 | 9/2002 | Usami et al. |
| 2003/0165708 | A1 | 9/2003 | Usami et al. |

FOREIGN PATENT DOCUMENTS

| | | |
|---|---|---|
| EP | 0 501 438 | 9/1992 |
| EP | 0 949 343 | 10/1999 |
| JP | 59-193233 | 11/1984 |
| JP | 61-127842 | 6/1986 |
| JP | 63-130739 | 6/1988 |
| JP | 01-180932 | 7/1989 |
| JP | 02-118037 | 5/1990 |
| JP | 02-170937 | 7/1990 |
| JP | 3-188247 | 8/1991 |
| JP | 5-1367 | 1/1993 |
| JP | 05-59468 | 3/1993 |
| JP | 5-311278 | 11/1993 |
| JP | 5-345941 | 12/1993 |
| JP | 06-41660 | 2/1994 |
| JP | 06-100983 | 4/1994 |
| JP | 07-54079 | 2/1995 |
| JP | 07-90520 | 4/1995 |
| JP | 10-330867 | 12/1998 |
| JP | 11-43731 | 2/1999 |
| JP | 11-140569 | 5/1999 |
| JP | 11-222641 | 8/1999 |
| JP | 11-256256 | 9/1999 |
| JP | 2002-38228 | 2/2002 |
| JP | 2002-180161 | 6/2002 |
| JP | 2002-339029 | 11/2002 |
| JP | 3094045 | 3/2003 |
| TW | 448235 | 8/2001 |

OTHER PUBLICATIONS

Journal of the Japan Copper and Brass Research Association, 2001, vol. 40, w/concise explanation thereof.

Furukawa Electric Review, No. 107, Jan. 2001, w/concise explanation thereof.

Synopses of the 38th Symposium of Copper and Brass Technical Research Association, published on Sep. 22, 1998, w/English translation.

Synopses of the 40th Symposium of Copper and Brass Technical Research Association, published on Sep. 20, 2000, w/English translation.

33rd Annual IICIT, 2000 Conference Proceeding of Oct. 23, 2000.

Japanese Office Action (Decision of Rejection) mailed Jan. 10, 2006 issued in corresponding Japanese Application No. 2001-148521.

Basic and Industrial Technique of Copper and Copper Alloy (Revised Edition); Japan Copper and Brass Association; 1988, 1994(revised); pp. 340-343, 475-476, 481-482 and 345(revised).

HIGH-MECHANICAL STRENGTH COPPER ALLOY

This application is a continuation-in-part application of U.S. patent application Ser. No. 09/966,389 filed on Sep. 27, 2001, now U.S. Pat. No. 6,893,514 claiming a foreign priority of JP2000-381863 filed on Dec. 15, 2000.

FIELD

The present invention relates to a high-mechanical strength copper alloy.

BACKGROUND

In accordance with recent trends for miniaturizing and making electric and electronic machinery and tools having a high performance, a material for components used therein, such as a connector, has been required to be further improved in all the features.

For example, a spring sheet used at a contact point of a connector has been modified to become thinner and thinner, which becomes difficult to keep a sufficient contact pressure. That is, when the spring sheet is deflected at a contact point of the connector, a counterforce is generated to give a contact pressure to make electrical connection. Therefore, the thinner the sheet is made, the larger the sheet has to be deflected to keep a contact pressure at a similar level. However, when the sheet is deflected to the extent exceeding an elasticity limit of the sheet, plastic deformation is occurred. Accordingly, additional improvement is demanded to prevent plastic deformation.

It is also demanded to improve the spring sheet in various features including stress relaxation property, heat conductivity, bending property, heat resistance, plate adhesion property, and migration resistant property. Among the properties, mechanical strength, stress relaxation, heat and electric conductivity, and bending property are important, when the material is used at a contact point of the connector.

Conventionally, phosphor bronze has been used at the contact point of the connector. However, it cannot be perfectly satisfied with the demands as described above. Accordingly, phosphor bronze recently has been replaced by a beryllium-copper alloy, that is an alloy prescribed in JIS C 1753. Such a beryllium-copper alloy has an improved mechanical strength and a good stress relaxation property, as well as a good electric conductivity. However, the beryllium-copper alloy is very expensive, and beryllium is toxic.

For these reasons, it is demanded to develop an alloy, which is inexpensive and nontoxic, and which is comparable to the beryllium-copper alloy. One of studies has been focused on a Cu—Ni—Si alloy since around 1985, since it has a high mechanical strength.

However, any of the Cu—Ni—Si alloys developed cannot be an alternative of the beryllium-copper alloy, since they are inferior in mechanical strength and stress relaxation resistance compared with the beryllium-copper alloy.

Besides, addition of Mg into a Cu—Ni—Si alloy has been proposed to improve a stress relaxation property. Addition of Mg improves stress relaxation resistance to some extent, but an improvement of the stress relaxation resistance in the level of beryllium-copper alloy has not been accomplished.

SUMMARY

The inventors of the present invention have studied to focus on solving the objectives as described above, and finally found the present invention.

According to the present invention, there is provided a sheet of a copper alloy having a high-mechanical strength. The copper alloy comprises 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities.

Alternatively, the copper alloy comprises 3.4 to 4.5% by mass of Ni, 0.75 to 1.0% by mass of Si, 0.05 to 0.20% by mass of Mg, 0.1 to 0.5% by mass of Sn, 0.4 to 0.6% by mass of Zn, and less than 0.005% by mass (including 0% by mass) of S, with the balance being made of Cu and inevitable impurities.

Alternatively, the copper alloy comprises 3.0 to 4.5% by mass of Ni, 0.65 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities.

Alternatively, the copper alloy comprises 1.0 to 4.5% by mass of Ni, 0.2 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities.

The alloy has a tensile strength of 800 $N/mm^2$ or more.

The alloy may have a stress relaxation ratio of 10% or less.

The copper alloy may include a crystal grain having a diameter from more than 0.001 mm to 0.025 mm.

The copper alloy may have a ratio (a/b), between a longer diameter a of a crystal grain on a cross section parallel to a direction of final plastic working, and a longer diameter b of a crystal grain on a cross section perpendicular to the direction of final plastic working, of 1.5 or less. In particular, the ratio (a/b) is preferably 0.8 or more.

The copper alloy may further comprises S at a content of less than 0.002% by mass.

The copper alloy may further comprise at least one selected from the group consisting of B, Fe, Zr, P, Mn, Ti, V, Pb, Bi and Al, at a total content of 0.01 to 0.5% by mass.

The copper alloy may further comprise at least one selected from the group consisting of Ag, Co and Cr, at a total amount of 0.005 to 2.0% by mass. The copper alloy may comprise Ag at an amount of 0.005 to 0.3% by mass. The copper alloy may comprise Co at an amount of 0.005 to 2.0% by mass. The copper alloy may comprise Cr, at an amount of 0.005 to 0.2% by mass.

According to the present invention, the alloy may be overaged. Preferably, wherein the copper alloy, when the alloy is subjected to an aging treatment, shows a maximum peak of the tensile strength at a peak temperature of 350 to 600° C.; and wherein the alloy is overaged at a temperature between the peak temperature and 50° C. above the peak temperature.

Other and further features and advantages of the present invention appear more fully from the following description in connection with the accompanying drawings.

DETAILED DESCRIPTION

Figure 1:
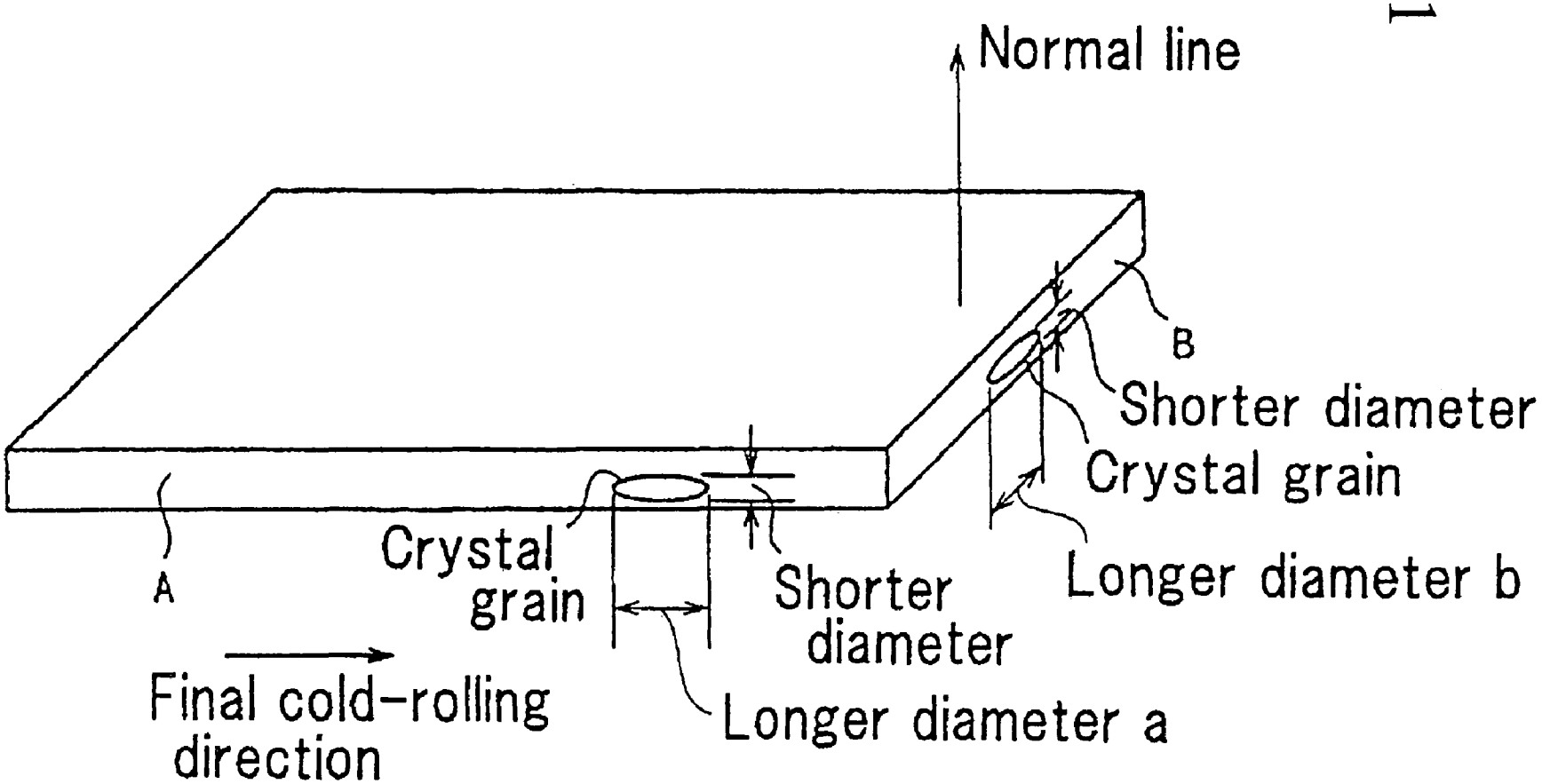
FIG. 1 is an explanatory view on the method for determining the crystal grain diameter and the crystal grain shape, each of which is defined in the present invention.

According to the present invention, there are provided the following means:

(1) A sheet of a copper alloy having a high-mechanical strength, the copper alloy comprising 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein the alloy has a tensile strength of 800 N/mm$^2$ or more, and wherein the alloy has a stress relaxation ratio of 10% or less.

(2) A sheet of a copper alloy having a high-mechanical strength, the copper alloy comprising 3.0 to 4.5% by mass of Ni, 0.65 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein the alloy has a tensile strength of 800 N/mm$^2$ or more, and wherein the alloy has a stress relaxation ratio of 10% or less.

(3) A sheet of a copper alloy having a high-mechanical strength, the copper alloy comprising 3.0 to 4.5% by mass of Ni, 0.65 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein the copper alloy, when the alloy is subjected to an aging treatment, shows a maximum peak of the tensile strength at a peak temperature of 350 to 600° C.; and wherein the alloy is overaged at a temperature between the peak temperature and 50° C. above the peak temperature.

(4) A sheet of a copper alloy having a high-mechanical strength, the copper alloy comprising 1.0 to 4.5% by mass of Ni, 0.2 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, with the balance being made of Cu and inevitable impurities, wherein the copper alloy, when the alloy is subjected to an aging treatment, shows a maximum peak of the tensile strength at a peak temperature of 350 to 600° C.; and wherein the alloy is overaged at a temperature between the peak temperature and 50° C. above the peak temperature.

The present invention is described in more detail hereinafter.

The present invention is a copper alloy to solve the objectives as described above, to meet the recent demands.

The present inventors have intensively studied a Cu—Ni—Si copper alloys, as reported in JP-A-11-222641 ("JP-A" means unexamined published Japanese patent application). We have further studied the copper alloy to improve stress relaxation property, plating characteristics and the like, which are required for enhancement of product reliability especially in the use as a connector, which is demanded in miniaturization in recent years. As a result, the present inventors have developed a copper alloy having excellent desired characteristics suitable for a connector material, by employing a specific elements composition as well as by controlling the metallurgical texture (e.g., a crystalline grain size, a crystalline grain shape) and/or the surface states (e.g., a surface roughness (Ra or Rmax)) of the copper alloy.

The present invention is a copper alloy particularly preferable as a material in a connector for electronic machinery and tools. The copper alloy of the present invention is applicable to any material to be used in parts for electric and electronic machinery and tools, which requires such characteristics as high mechanical strength, good conductivity (heat and electric conductivity), bending property, stress relaxation property, and plate adhesion property.

One of the essences of the copper alloy of the present invention is that, a compound of Ni and Si is precipitated in a Cu matrix to give the alloy a specific mechanical strength and an appropriate electric conductivity. In addition, each of Sn, Mg and Zn is added at a specific amount. Further, the copper alloy of the present invention is designed to have a specific crystal grain diameter from more than 0.001 mm to 0.025 mm. Furthermore, the copper alloy of the present invention is designed to have a ratio (a/b), between the longer diameter a of the crystal grain on the cross section parallel to the direction of final plastic working, and the longer diameter b of the crystal grain on the cross section perpendicular to the direction of final plastic working, is made to be 1.5 or less. Thus, improvements of bending property and stress relaxation property are obtained.

The inventors of the present invention have newly found that in order to obtain a copper alloy having a specific features, it is important to strictly control contents of Ni, Si, Mg, Sn and Zn, a crystal grain diameter, and a shape of a crystal grain. Thereby, the copper alloy of the present invention has stress relaxation similar to, or superior to, that of the conventional beryllium-copper alloy. The inventors of the present invention, having studied intensively, have completed the present invention based on these findings.

The alloy elements in the copper alloy of the present invention are described hereinafter.

It is known that Ni and Si are added in Cu to form a Ni—Si compound (a $Ni_2Si$ phase) precipitated in a Cu matrix, to improve mechanical strength and electric conductivity.

According to the present invention, Ni is added at a content of 1.0 to 4.5% by mass, preferably of 3.4 to 4.5% by mass, much preferably of 3.0 to 4.5% by mass, more preferably of 3.5 to 4.5% by mass, and most preferably of 3.5 to 4.0% by mass. The content of Ni is defined to obtain a mechanical strength similar to, or superior to that of the conventional beryllium-copper alloy. When the content of Ni is lower than the range as defined in the present invention, a desired mechanical strength is not obtained. On the other hand, when the Ni is added more than the range as defined in the present invention, a compound having a too large grain size is grown during casting or hot-working to be precipitated (recrystallized), not expecting improvement of mechanical strength in accordance with the Ni amount added, rather adversely affecting hot-working property and bending property.

According to the present invention, Si is added in a content of 0.2 to 1.0% by mass, preferably of 0.65 to 1.0% by mass, more preferably of 0.7 to 1.0% by mass, and most preferably of 0.75 to 0.95% by mass. Si and Ni form a $Ni_2Si$ phase, and thus, Si is defined to be added in accordance with the amount of Ni added. Si is added at the content as defined in the present invention, the copper alloy has mechanical strength similar to, or superior to, that of the beryllium-copper alloy. In other words, when Si is added at an amount lower than the range as defined in the present invention, it is difficult to obtain a copper alloy having a mechanical strength similar to, or superior to, that of the beryllium-copper alloy. On the other hand, Si is added at an amount more than the range of the present invention, similar problems may occur in the case where Ni is added too much.

Mechanical strength is varied depending on contents of Ni and Si, and stress relaxation is also varied. Therefore, the Ni and Si contents should be strictly controlled within the ranges as defined in the present invention. Thus, a stress relaxation property similar to, or superior to, that of the beryllium-copper alloy can be obtained.

According to the present invention, Mg, Sn and Zn are added as essential elements. These elements are important in preparing the copper alloy of the present invention. These elements in the alloy are correlated with each other, realizing well-balanced excellent characteristics.

According to the present invention, Mg is added in an amount of 0.01 to 0.2% by mass, preferably of 0.03 to 0.2% by mass, and much preferably of 0.05 to 0.2% by mass. Mg favorably improves stress relaxation, adversely affecting bending property. The more Mg is added, the more the stress relaxation is improved, so long as Mg is added at an amount of at least 0.01% by mass. However, if Mg is added at an amount more than 0.2% by mass, the resultant alloy cannot be satisfied with a required bending property. The copper alloy of the present invention is much reinforced by a precipitated $Ni_2Si$ phase compared with the conventional Cu—Ni—Si alloys. In connection with such reinforcement, the alloy is however apt to be inferior in bending formability. Therefore, the content of Mg should be strictly controlled in the present invention.

According to the present invention, Sn is added in an amount of 0.05 to 1.5% by mass, preferably of 0.05 to 1.0% by mass, and most preferably of 0.1 to 0.5% by mass. Sn remarkably improves stress relaxation, when it is added in combination with Mg. Addition of Sn alone less improves stress relaxation property than addition of Mg alone. However, if Sn is added in combination with Mg, improvements in stress relaxation resistance much higher than addition of Mg alone can be expected in the present invention. When Sn is added at an amount lower than the range as defined in the present invention, it is difficult to obtain a sufficient effect for adding Sn. On the other hand, when Sn is added at an amount more than the range as defined in the present invention, electric conductivity is significantly decreased.

According to the present invention, Zn is added in an amount of 0.2 to 1.5% by mass, preferably of 0.2 to 1.0% by mass, and much preferably of 0.4 to 0.6% by mass. Addition of Zn slightly improves bending property. By adding Zn in an amount as defined in the present invention, bending property is maintained in, or improved into, a practically non-problematic level even, if Mg is added in the maximum amount of 0.2% by mass. In addition, addition of Zn improves adhesion property with a Sn plate or solder plate, as well as a migration resistant property. When Zn is added in an amount lower than the range as defined in the present invention, it is difficult to sufficiently obtain an effect of Zn addition. On the other hand, when Zn is added more than the range as defined in the present invention, electric conductivity is decreased.

Sub-component elements such as Ag, Co and Cr may be included to further improve mechanical strength, which are described hereinafter.

According to the present invention, Ag may be added in an amount of 0.005 to 0.3% by mass, and preferably 0.005 to 0.15% by mass. Addition of Ag improves heat resistance and mechanical strength, and prevents a crystal grain from excessively growing so as to improve bending property. When Ag is added at an amount lower than the range as defined in the present invention, it is difficult to sufficiently obtain an effect of Ag addition. On the other hand, when Ag is added in an amount more than the range as defined in the present invention, manufacturing cost of the alloy is increased, although no adverse effects are observed on the resulting characteristics.

According to the present invention, Co may be added in an amount of 0.005 to 2.0% by mass, and preferably of 0.005 to 1.0% by mass. In particular, Co is preferably added at a lower limit of 0.05% by mass. Co forms a compound with Si as Ni does, to improve mechanical strength. When Co is added in an amount lower than the range as defined in the present invention, it is difficult to sufficiently obtain the effect of Co addition. On the other hand, when Co is added in an amount more than the range as defined in the present invention, bending property is decreased.

According to the present invention, Cr may be added in an amount of 0.005 to 2.0% by mass, and preferably 0.005 to 0.1% by mass. Cr forms a fine precipitate in the Cu matrix, to increase mechanical strength. When Cr is added in an amount lower than the range as defined in the present invention, it is difficult to sufficiently obtain an effect of Cr addition. On the other hand, when Cr is added in an amount more than the range as defined in the present invention, bending property is decreased.

Ag, Co and Cr may be added alone, or in combination thereof. If they are added in combination of at least two of them, they are added in a sum total amount of 0.005 to 2.0% by mass, and preferably 0.005 to 1.25% by mass. The total amount may be varied to modify the characteristics at customer's requests.

According to the present invention, S is restricted to be included into an amount less than 0.005% by mass, and preferably, less than 0.002% by mass (including 0% by mass), since hot-working property is adversely affected by the presence of S. According to the present invention, it is possible to add another elements such as B, Fe, Zr, P, Mn, Ti, V, Pb, Bi and Al. These elements may be added alone, or in combination thereof. These elements may be added in a sum total amount of 0.01 to 0.5% by mass, so long as essential characteristics of the present invention, such as mechanical strength and electric conductivity, are not affected.

In particular, Mn improves hot-working property. Mn may be added in an amount of 0.01 to 0.5% by mass, so long as electric conductivity is not significantly decreased.

In the copper alloy of the present invention, the balance of the alloy may be of Cu and inevitable impurities. However, the alloy of the present invention may comprise other elements than the essential elements as defined in the present invention, so long as essential characteristics of the present invention, such as high mechanical property, is not adversely affected. One skill in the art may modify of the present invention within the scope of the present invention as defined in the attached claims.

According to the present invention, the alloy is designed to have a crystal grain diameter and a shape of a crystal grain, both being strictly defined. Thereby, the copper alloy of the present invention is accomplished to have favorable characteristics.

In the present invention, the alloy has a crystal grain diameter from more than 0.001 mm to 0.025 mm. When the alloy has a crystal grain diameter less than 0.001 mm, the alloy has a recrystallized texture of mixed grains (a texture including crystal grains having various sizes), so as to decrease bending property and stress relaxation. On the other hand, when the alloy has a crystal grain diameter more than 0.025 mm, bending property is decreased. According to the present invention, a value of the crystal grain diameter is measured according to JIS H 0501 (a cutting method).

In the present invention, the shape of the crystal grain is expressed by a ratio (a/b), between the longer diameter a of the crystal grain on the cross section parallel to the direction of final plastic working, and the longer diameter b of the crystal grain on the cross section perpendicular to the direction of final plastic working. Herein, the term "direction of final plastic working" means a moving direction of a subject (e.g. a sheet, a strip) worked in a final plastic working, regardless of an angle formed by this direction and a direction of a roller and the like.

The copper alloy may have the ratio (a/b) of 1.5 or less, and/or it may have the ratio (a/b) of (1/1.5) or more, and preferably of 0.8 or more, so as to prevent stress relaxation resistance from being decreased.

Each of the longer diameter a and the longer diameter b may be determined from an averaged value of 20 or more pieces of the crystal grain.

With respect to improvement in the stress relaxation property of the alloy, it is important to control the crystalline grain shape defined by the ratio (a/b) of the alloy. For keeping the stress relaxation property high, the crystal grain most preferably has an isotropic shape; i.e. a sphere having an equivalent diameter in any directions. However, in general, it is clear that a thickness of an individual crystal grain is made thinned down, by working including a final plastic working (rolling) when producing materials desired. Then, the crystal grain diameter in the rolling direction (MD) is enlarged. The thinned thickness and the enlarged diameter depend on a reduction ratio in the rolling step. By a usual working (rolling), a copper alloy material deteriorated in stress relaxation property is obtained. The present inventors have discovered that despite the thickness of grain thinned down, stress relaxation property of the copper alloy can be prevented from deteriorating, or rather be improved, by a specific measure.

The copper alloy of the present invention can be manufactured, for example, by the steps comprising: hot-rolling an ingot of the alloy, cold-rolling the alloy, subjecting the ally to heat treatment to form a solid solution, subjecting the alloy to heat treatment for aging, subjecting the alloy to final cold-rolling, and subjecting the alloy to low-temperature annealing.

In the present invention, the crystal grain diameter and the shape of the crystal grain as, defined in the present invention can be obtained by adjusting conditions of the manufacturing process, such as heat-treatment condition, rolling reduction, direction of rolling, back-tension in rolling, lubrication condition in rolling, and path numbers in rolling.

When a heat treatment is carried out under a heat treatment condition identical to another heat treatment, the resultant crystal grain diameter depends on working history (e.g., hot-working conditions and cold-working conditions) before the heat-treatment. The crystal grain diameter can be controlled by combining the above conditions appropriately. Similarly, the shape of crystal grains, i.e. the ratio (a/b), can also be controlled, for example, according to a heat treatment condition and working condition (e.g. by carrying out a final plastic working, such as cold-rolling, at a low working amount (a low reduction, at about 0 to 33%), including cold-rolling by skin-pass.) In particular, in rolling, the shape of the crystal grain can be controlled as desired, according to not only a one-direction-rolling method but also a cross-rolling method, even if the rolling ratios thereof are identical. According to the cross-rolling method, the shape of the crystal grain (a/b) can be made to 1 or less, attaining the purpose of the present invention.

For example, the ratio (a/b) of 1 or less may be made by means of a cross-rolling method. For example, one example to carry out cold-working at a reduction of 20% is a two-step cross cold-rolling method, comprising a first rolling at a rolling ratio of 10% in one direction (e.g. a longitudinal direction of the strip-shape alloy), and a second rolling at a rolling ratio of 10% in another direction (e.g. a direction forming an angle of 30° to 90° (90° is the perpendicular direction) to the first rolling direction). Alternatively, the cold-working at a reduction of 20% can be carried out, by a one-step cold-rolling method at a rolling ratio of 20% in only one direction. By the one-direction rolling method or the cross rolling method, the copper alloys having the ratio (a/b) different from each other can be obtained with a reduction ratio identical to each other. By controlling the ratio (a/b), it is possible to improve both bending and stress relaxation property, appropriately.

As an embodiment, the crystal grain diameter and the shape of the crystal grain can be controlled, for example, by varying heat-treatment conditions, including a temperature and period of the heat-treatments for forming a solid solution and for aging. Alternatively, the extent of the reduction in the final cold-rolling step may be adjusted to control the crystal grain diameter and the shape of the crystal grain.

The direction of the final plastic working as used in the present invention means a rolling direction where a rolling is finally carried out as a plastic working, and a drawing direction where a drawing or a linear drawing is finally carried out as a plastic working. The plastic working means to include a rolling and a drawing, but not including a level working, such as a vertical leveling, by means of a tension leveler and so on.

Figure 2:
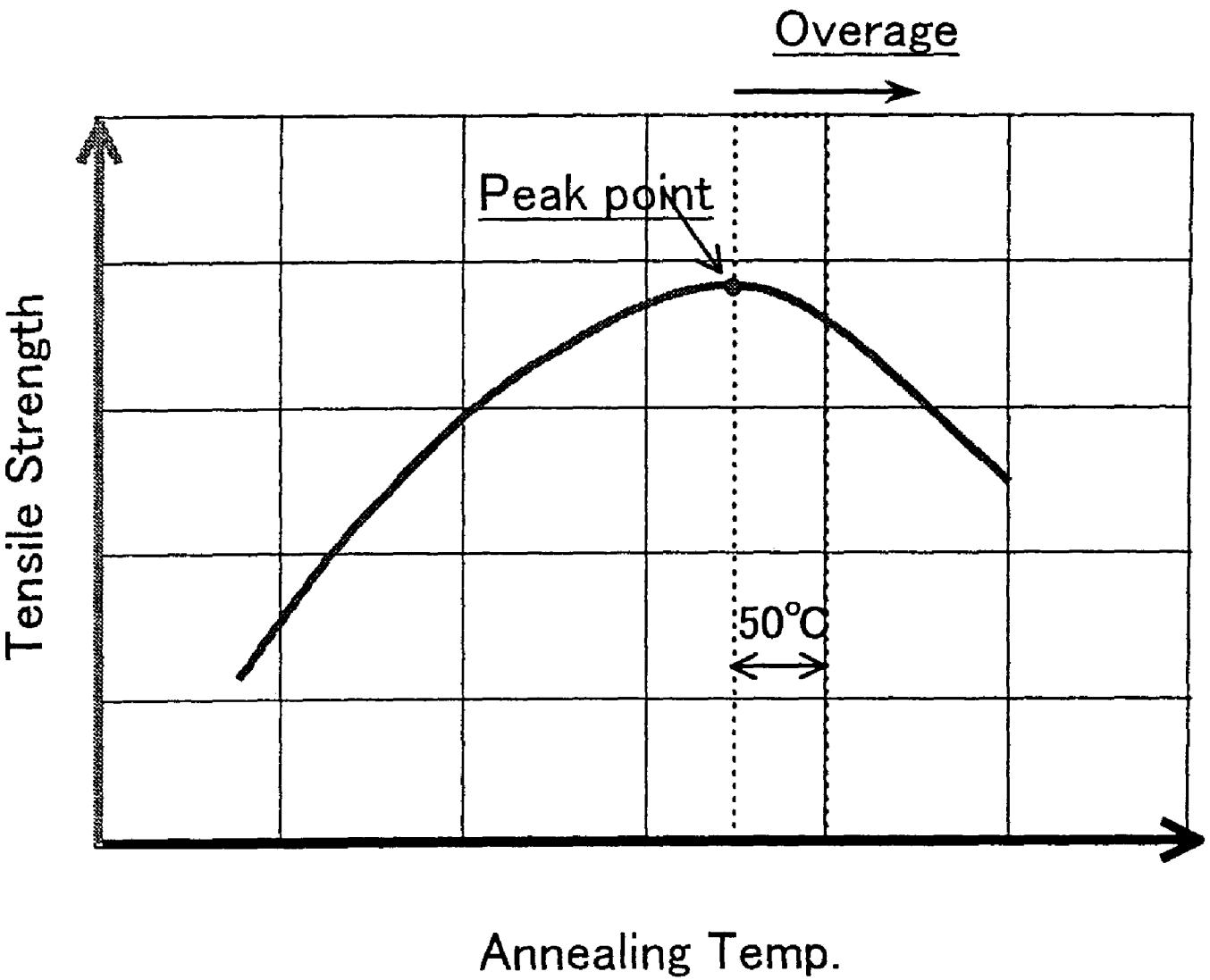
FIG. 2 is an illustrative view of a tensile strength curve when the copper alloy of the present invention is subjected to an age treatment at a temperature ranging 350 to 600° C.

According to the present invention, the alloy is overaged. The alloy has a state chart of tensile strength as shown in FIG. 2. When the alloy is subjected to an aging treatment at various temperatures, the alloy is found to show a maximum peak of the tensile strength at a peak temperature of 350 to 600° C. The alloy of the present invention is preferably overaged at a temperature between the peak temperature and 50° C. above the peak temperature. Thereby, the alloy of the present invention has an improved combination of tensile strength and electrical conductivity.

According to the present invention, the copper alloy has a tensile strength of 800 $N/mm^2$ or more, for the purpose of accomplishing a sufficient stress relaxation resistance. While the reason has not been clarified yet, the tensile strength relates to stress relaxation property. Concretely, the lower the tensile strength becomes, the lower the stress relaxation resistance becomes. The copper alloy of the present invention should be designed to have a tensile strength more than 800 $N/mm^2$, by selecting, for example, a rolling condition. Thereby, the copper alloy of the present invention has a stress relaxation property similar to, or superior to, that of the beryllium-copper alloy.

The high-mechanical strength copper alloy of the present invention is excellent in mechanical strength, electric conductivity, bending property, stress relaxation property, and plate adhesion property. Therefore, the copper alloy of the present invention can be favorably satisfied with the demands necessary for the parts of electric and electronic machinery and tools which are in process of miniaturization with a higher performance as well as long durability and reliability of performance. The copper alloy of the present invention is preferably used as a material for terminals, connectors and switches, including general-purpose conductive materials such as switches, relays and so on. Accordingly, the copper alloy of the present invention has industrially excellent properties.

The present invention is described in more detail based on the following examples, but the invention should not construed to be limited thereto.

EXAMPLE

Example 1

Copper alloys, each having a composition as defined in the present invention, as shown in Table 1 (Nos. A to D), were melted in a microwave melting furnace, to cast them into ingots having a thickness of 30 mm, a width of 100 mm and a length of 150 mm, by means of a DC method, respectively. Then, these ingots were heated at 1,000° C. After holding the ingots at this temperature for 30 minutes, they were hot-rolled to prepare a sheet having a thickness of 12 mm, followed by subjecting them to rapid cooling. Then, both of the end faces of the hot-rolled sheet were cut (chamfered) by 1.5 mm, to remove an oxidation film. The resultant sheets were worked to have a thickness of 0.265 to 0.280 mm by cold rolling (a). The cold-rolled sheets were then heat-treated at a temperature of 875 to 900° C. for 15 seconds, immediately followed by cooling them at a cooling rate of 15° C./sec or more. The rolling was carried out, appropriately, with a one-direction rolling method or a cross-rolling method. Then, an aging treatment was carried out at 475° C. for 2 hours in an inert gas atmosphere, and cold rolling (c) as a final plastic working was carried out thereafter, to obtain a final sheet having a thickness of 0.25 mm. After the final plastic working, the samples were then subjected to a low-temperature annealing at 350° C. for 2 hours, thereby obtaining copper alloy sheets.

Comparative Example 1

Copper alloy sheets having a thickness of 0.25 mm were manufactured by working, in accordance with the following conditions. Each of the copper alloys (Nos. A and B) has a composition defined in the present invention, as shown in Table 1.

The same manufacturing steps described in Example 1 were employed, except the followings. After the hot-rolling, the resultant sheets were then worked by cold-rolling (a) into a thickness of 0.265 to 0.50 mm, followed by heat-treating the sheets for 15 seconds at a temperature of 875 to 925° C. Immediately thereafter, the sheets were cooled at a cooling rate of 15° C./sec or more. Then, a cold-rolling step (b) with a rolling reduction of 50% or less was carried out depending on the samples, if necessary. Then, under the same conditions as Example 1, the resultant sheets were subjected to an aging treatment in an inert gas atmosphere, a final plastic working (cold-rolling (c), to a final sheet thickness of 0.25 mm), and a low-temperature annealing, thereby obtaining copper alloy sheets.

Comparative Example 2

Copper alloy sheets were manufactured in the same manner as Example 1, except that the compositions of the copper alloys (Nos. E to M) were outside the ranges of the present invention, as shown in Table 1.

Comparative Example 3

Copper alloy sheets having a thickness of 0.25 mm were manufactured by working the copper alloys in the following conditions. The compositions of the copper alloys (Nos. H and K) were outside the ranges of the present invention, as shown in Table 1.

The same manufacturing steps as Example 1 were employed, except the followings. After the hot-rolling, the resultant sheets were then worked by cold-rolling (a) into a thickness of 0.40 to 0.42 mm, followed by subjecting the sheets to heat-treating for 15 seconds at a temperature of 850 to 875° C. Immediately thereafter, the sheets were cooled at a cooling rate of 15° C./sec or more. Then, under the same conditions as Example 1, the resultant sheets were subjected to an aging treatment in an inert gas atmosphere, a final plastic working (cold-rolling (c), to a final sheet thickness of 0.25 mm), and a low-temperature annealing, thereby obtaining copper alloy sheets.

Each of the copper alloy sheets manufactured in Example 1 and Comparative examples 1 to 3 were tested to evaluate the followings: (1) crystal grain diameter, (2) crystal grain shape, (3) tensile strength and elongation, (4) electric conductivity, (5) bending property, (6) stress relaxation property, and (7) resistance to peeling plate under heat (plate adhesion property). One sheet of a conventional beryllium-copper alloy (the alloy prescribed in JIS C 1753) was also tested to evaluate the same properties as described above.

The crystal grain diameter (1) was calculated based on the measurement according to JIS H 0501 (a cutting method).

That is, as shown in FIG. 1, the crystal grain diameter was measured at both of the cross section A parallel to the direction of a final cold-rolling of the sheet (the direction of a final plastic working), and the cross section B perpendicular to the direction of the final cold-rolling. On the cross section A, the crystal grain diameters were measured in two directions: the direction parallel to the final cold-rolling direction; and the direction perpendicular to the final cold-rolling direction. Among the measured values therefrom, a larger value was referred to as a longer diameter a, and a smaller value was referred to as a shorter diameter, respectively. On the cross section B, the crystal grain diameters were measured in two directions: the direction parallel to the normal line of a sheet surface, and the direction perpendicular to the normal line of the sheet surface. Among the measured values, a larger values was referred to as a longer diameter a, and a smaller value was referred to as a shorter diameter, respectively.

The crystalline texture of the copper alloy sheet was photographed by a scanning electron microscope with a 1000-fold magnification, and line segments having a length of 200 mm were drawn on the resultant photograph, and the number "n" of the crystal grains equal to, or shorter than, the line segment was counted, to make calculation by the following equation: (the crystal grain diameter)={200 mm/(n×1000)}. When the number of the crystal grains shorter than the line segment was less than 20, the crystal grains were photographed with a 500-fold magnification, and the number "n" of the crystal grains equal to, or shorter than, the line segment with a length of 200 mm was counted, to make calculation by the following equation: (the crystal grain diameter)={200 mm/(n×500)}.

(1) As to the crystal grain size, four values, that are, the two longer diameters and the two shorter diameters obtained on the cross sections A and B, were averaged and approached into the nearest number of an integral multiple of 0.005 mm.

(2) As to the shape of the crystal grain, the longer diameter a on the cross section A is divided by the longer diameter b on the cross section B to obtain a value (a/b).

(3) As to tensile strength and elongation, #5 test pieces as described in JIS Z 2201 were used to carry out examinations in accordance with JIS Z 2241.

(4) Electric conductivity was determined in accordance with JIS H 0505.

(5) Bending property was evaluated as to a sheet sample having a width of 0.44 mm. The sheet sample was subjected to a 90° bending test at an inner bending radius of 0.1 millimeter. When no crack was observed at the bent portion, the sample sheet was determined to be good (○). On the other hand, when cracks were observed there, the sample sheet was determined to be poor (x).

(6) As to an evaluation of a stress relaxation property, a one-side holding block method in accordance with Electronics Materials Manufacturers Association of Japan Standard (EMAS-3003) was carried out. In this method, the stress load was set in a manner to obtain a maximum surface stress of 600 N/mm$^2$. The resultant test pieces were maintained in a constant temperature chamber at 150° C. for 1,000 hours, and then, a stress relaxation ratio (S.R.R.) was calculated. The stress relaxation property was evaluated to be good when the stress relaxation ratio (S.R.R.) was 10% or less, and to be poor when the S.R.R. was more than 10%.

(7) The plate adhesion property was evaluated in the following manner. A test piece of each of the sample sheets was plated with a eutectic solder having a thickness 3 μm. The resultant test piece was heated at 150° C. for 1,000 hours in an atmospheric air, followed by subjecting it to a 90-degree bending and bending back. After that, the adhesion state of the solder plate was observed at the bent portion thereof with the naked eyes. When no peeling off was observed on the plate, the sample sheet was evaluated to be good (○) as to the adhesion property. On the other hand, when the plate was peeled off, the sample sheet was evaluated to be poor (x).

The results are shown in Table 2.

TABLE 1

| | Ingot No. | Ni mass % | Si mass % | Mg mass % | Sn mass % | Zn mass % | S mass % | Other elements mass % |
|---|---|---|---|---|---|---|---|---|
| Example of this invention | A | 3.9 | 0.90 | 0.10 | 0.18 | 0.49 | 0.002 | |
| | B | 4.0 | 0.91 | 0.06 | 0.52 | 0.50 | 0.002 | |
| | C | 3.8 | 0.89 | 0.11 | 0.19 | 0.49 | 0.002 | Ag 0.02 |
| | D | 3.9 | 0.90 | 0.11 | 0.18 | 0.50 | 0.002 | Cr 0.006 |
| Comparative example | E | 3.2 | 0.68 | 0.10 | 0.20 | 0.50 | 0.002 | |
| | F | 5.0 | 1.17 | 0.10 | 0.21 | 0.49 | 0.002 | |
| | G | 3.9 | 0.89 | <0.01 | 0.21 | 0.50 | 0.002 | |
| | H | 3.9 | 0.90 | 0.38 | 0.20 | 0.50 | 0.002 | |
| | I | 4.0 | 0.90 | 0.10 | 0.02 | 0.50 | 0.002 | |
| | J | 3.9 | 0.89 | 0.08 | 2.01 | 0.50 | 0.002 | |
| | K | 3.9 | 0.88 | 0.09 | 0.20 | 0.12 | 0.002 | |
| | L | 3.9 | 0.88 | 0.08 | 0.19 | 0.51 | 0.002 | Cr 0.4 |
| | M | 1.9 | 0.46 | 0.09 | 0.33 | 0.49 | 0.011 | |
| Conventional example | JIS C1753 alloy: Cu-0.3 mass % Be-1.9 mass % Ni-0.5 mass % Al | | | | | | | |

Note)
In the ingot Nos. A to M, the balance was made of Cu and unavoidable impurities.

TABLE 2

| Classification | Ingot No. | Sample No. | Crystal grain diameter (mm) | Shape of crystal grain | Tensile strength (N/mm$^2$) | Elongation (%) | Electric conductivity (% IACS) | Bending property (presence or absence of cracks) | S.R.R. (%) | Peeling of plate |
|---|---|---|---|---|---|---|---|---|---|---|
| Example of this invention | A | 1 | 0.005 | 1.1 | 880 | 12 | 33 | ○ | 8 | ○ |
| | A | 2 | 0.005 | 0.7 | 885 | 11 | 33 | ○ | 10 | ○ |
| | A | 3 | 0.005 | 1.2 | 890 | 10 | 33 | ○ | 9 | ○ |
| | A | 4 | 0.010 | 1.1 | 875 | 12 | 32 | ○ | 7 | ○ |
| | B | 5 | 0.005 | 1.1 | 895 | 11 | 29 | ○ | 7 | ○ |
| | C | 6 | 0.005 | 1.0 | 900 | 12 | 33 | ○ | 8 | ○ |
| | D | 7 | 0.005 | 1.1 | 900 | 10 | 33 | ○ | 8 | ○ |
| Comparative example | E | 8 | 0.005 | 1.1 | 730 | 18 | 39 | ○ | 17 | ○ |
| | F | 9 | The production was stopped and not completed due to occurrence of cracks during hot-working. | | | | | | | |
| | G | 10 | 0.005 | 1.0 | 880 | 12 | 34 | ○ | 19 | ○ |
| | H | 11 | 0.005 | 1.1 | 890 | 10 | 31 | X | 7 | ○ |
| | H | 12 | 0.005 | 1.6 | 910 | 9 | 31 | X | 18 | ○ |
| | I | 13 | 0.005 | 1.1 | 870 | 12 | 35 | ○ | 14 | ○ |
| | J | 14 | The production was stopped and not completed due to occurrence of edge cracks during cold-rolling. | | | | | | | |
| | K | 15 | 0.005 | 1.1 | 885 | 10 | 34 | X | 8 | X |
| | K | 16 | <0.001 | 1.7 | 900 | 8 | 34 | X | 20 | X |

TABLE 2-continued

| Classification | Ingot No. | Sample No. | Crystal grain diameter (mm) | Shape of crystal grain | Tensile strength (N/mm$^2$) | Elongation (%) | Electric conductivity (% IACS) | Bending property (presence or absence of cracks) | S.R.R. (%) | Peeling of plate |
|---|---|---|---|---|---|---|---|---|---|---|
| | L | 17 | 0.005 | 1.0 | 890 | 11 | 33 | X | 7 | ○ |
| | M | 18 | The production was stopped and not completed due to occurrence of cracks during hot-working. | | | | | | | |
| | A | 19 | 0.005 | 1.7 | 910 | 9 | 32 | ○ | 19 | ○ |
| | A | 20 | 0.005 | 2.0 | 920 | 8 | 32 | X | 25 | ○ |
| | A | 21 | 0.030 | 1.1 | 870 | 12 | 33 | X | 7 | ○ |
| | A | 22 | <0.001 | 1.0 | 890 | 10 | 32 | X | 9 | ○ |
| | B | 23 | 0.030 | 2.0 | 925 | 8 | 28 | X | 23 | ○ |
| Conventional example JIS C1753 | | | — | — | 860 | 13 | 33 | ○ | 10 | ○ |

(Note):
Sample Nos. 1 to 7 were produced according to Example 1. Sample Nos. 19 to 23 were produced according to Comparative example 1. Sample Nos. 8 to 11, 13 to 15, 17, and 18 were produced according to Comparative example 2. Sample Nos. 12 and 16 were produced according to Comparative example 3.

As is apparent from the results as shown in Table 2, each of samples Nos. 1 to 7, as the examples of the present invention, showed excellent properties in all the features tested.

On the contrary, each of the comparative examples were poor in any of the characteristics, as described below.

Sample No. 8, as a comparative example, was low in tensile strength and also poor in stress relaxation property. These properties were found to be inferior to those of the conventional JIS C1753 alloy. These inferiorities in sample No. 8 is considered to come from too small contents of Ni and Si.

Sample No. 9, as a comparative example, could not be normally produced, since cracks were occurred during hot-working, which were considered to be caused by excess amounts of Ni and Si.

Samples No. 10 and No. 13, as comparative examples, were poor in stress relaxation property, since each of the Mg content in sample No. 10 and the Sn content in sample No. 13 were outside the range of the present invention.

Sample No. 11, as comparative examples, was poor in bending property, since the content of Mg was too much.

Sample No. 12, as comparative examples, was poor in bending property and stress relaxation property, since the Mg content was too much and the shape of the crystal grains was outside the range of the present invention.

Sample No. 14, as comparative examples, could not be produced, since during the step of cold-rolling, edge cracks were occurred, which were considered to be caused by an excess amount of Sn.

Sample No. 15, as comparative examples, was poor in bending property, and the plate of the sample was peeled off. These inferiorities were considered to be due to too small content of Zn.

Sample No. 16, as comparative examples, was poor in bending property, plate adhesion property (Peeling off of the plate was occurred.), and stress relaxation property. These inferiorities were considered to come from too small content of Zn, and the outside of the ranges of the present invention as to the crystal grain diameter and the crystal grain shape.

Sample No. 17, as comparative examples, was poor in bending property, since the content of Cr was considered to be outside the range of the present invention.

Sample No. 18, as comparative examples, could not be normally manufactured, since cracks were occurred during the step of hot-rolling. This inferiority was considered to be caused by an excess amount of S. The copper alloy of this sample has the S content outside the range of the present invention, and too small contents of Ni and Si.

Samples No. 19 and No. 20, as comparative examples, were remarkably poor in stress relaxation property, since the shape of the crystal grains was outside the range of the present invention. In sample No. 20, bending property was also poor.

Samples of No. 21 and No. 22, as comparative examples, were poor in bending property, since the crystal grain diameter was outside the range of the present invention. Sample No. 23, as a comparative example, was poor in bending property and stress relaxation property, since the crystal grain shape and the crystal grain diameter were outside the ranges of the present invention.

Thought the present invention is described in connection with embodiments, the invention should not be construed to be limited into any details of the description. One skill in the art may modify the present invention within its spirit and scope set forth in the claims.

What is claimed is:

1. A sheet of a copper alloy having a high-mechanical strength, the copper alloy consisting of 3.5 to 4.5% by mass of Ni, 0.7 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of S, optionally 0.01 to 0.5% by mass at a total content of at least one selected from the group consisting of B, Fe, Zr, P, Mn, Ti, V, Pb, Bi and Al, and optionally 0.005 to 2.0% by mass at a total amount of at least one selected from the group consisting of Ag, Co and Cr, with the balance being made of Cu and inevitable impurities, wherein the alloy has a tensile strength of 800 N/mm$^2$ or more, and wherein the alloy has a stress relaxation ratio of 10% or less when the alloy is maintained at a temperature of 150° C. for a period of 1000 hours.

2. A sheet according to claim 1, wherein a crystal grain of the copper alloy has a diameter from more than 0.00 1 mm to 0.025 mm.

3. A sheet according to claim 2, wherein the copper alloy has a ratio (a/b), between a longer diameter a of a crystal grain on a cross section parallel to a direction of final plastic working, and a longer diameter b of a crystal grain on a cross section perpendicular to the direction of final plastic working, of 1.5 or less.

4. A sheet according to claim 3, wherein the ratio (a/b) is 0.8 or more.

5. A sheet according to claim 1, wherein S is included at a content of less than 0.002% by mass.

6. A sheet according to claim 1, wherein Ag is included at an amount of 0.005 to 0.3% by mass.

7. A sheet according to claim 1, wherein Co is included at an amount of 0.005 to 2.0% by mass.

8. A sheet according to claim 1, wherein Cr is included at an amount of 0.005 to 0.2% by mass.

9. A sheet according to claim 1, wherein the copper alloy is overaged.

10. A sheet according to claim 1, wherein the copper alloy, when the alloy is subjected to an aging treatment, shows a maximum peak of the tensile strength at a peak temperature of 350 to 600° C.; and wherein the alloy is overaged at a temperature between the peak temperature and 50° C. above the peak temperature.

11. A sheet according to claim 1, wherein the copper alloy, when the alloy is subjected to an aging treatment, shows a maximum peak of the tensile strength at a peak temperature of 350 to 600° C.; and wherein the alloy is overaged at a between the peak temperature and 50° C. above the peak temperature.

12. A sheet of a copper alloy having a high-mechanical strength, the copper alloy consisting of 3.0 to 4.5% by mass of Ni, 0.65 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of 5, optionally 0.01 to 0.5% by mass at a total content of at least one selected from the group consisting of B, Fe, Zr, P, Mn, Ti, V, Pb, Bi and Al, and optionally 0.005 to 2.0% by mass at a total amount of at least one selected from the group consisting of Ag, Co and Cr, with the balance being made of Cu and inevitable impurities, wherein the alloy has a tensile strength of 800 N/mm$^2$ or more, and wherein the alloy has a stress relaxation ratio of 10% or less when the alloy is maintained at a temperature of 150° C. for a period of 1000 hours.

13. A sheet according to claim 12, wherein the copper alloy is overaged.

14. A sheet according to claim 12, wherein a crystal grain of the copper alloy has a diameter from more than 0.001 mm to 0.025 mm.

15. A sheet according to claim 12, wherein the copper alloy has a ratio (a/b), between a longer diameter a of a crystal grain on a cross section parallel to a direction of final plastic working, and a longer diameter b of a crystal grain on a cross section perpendicular to the direction of final plastic working, of 1.5 or less.

16. A sheet according to claim 12, wherein the ratio (a/b) is 0.8 or more.

17. A sheet according to claim 12, wherein S is included at a content of less than 0.002% by mass.

18. A sheet according to claim 12, wherein Ag is included at an amount of 0.005 to 0.3% by mass.

19. A sheet according to claim 12, wherein Co is included at an amount of 0.005 to 2.0% by mass.

20. A sheet according to claim 12, wherein Cr is included at an amount of 0.005 to 0.2% by mass.

21. A sheet of a copper alloy having a high-mechanical strength, the copper alloy consisting of 3.0 to 4.5% by mass of Ni, 0.65 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of 5, optionally 0.01 to 0.5% by mass at a total content of at least one selected from the group consisting of B, Fe, Zr, P, Mn, Ti, V, Pb, Bi and Al, and optionally 0.005 to 2.0% by mass at a total amount of at least one selected from the group consisting of Ag, Co and Cr, with the balance being made of Cu and inevitable impurities, wherein the copper alloy, when the alloy is subjected to an aging treatment, shows a maximum peak of the tensile strength at a peak temperature of 350 to 600° C.; and wherein the alloy is overaged at a between the peak temperature and 50° C. above the peak temperature, wherein the alloy has a stress relaxation ratio of 10% or less when the alloy is maintained at a temperature of 150° C. for a period of 1000 hours.

22. A sheet according to claim 21, wherein a crystal grain of the copper alloy has a diameter from more than 0.001 mm to 0.025 mm.

23. A sheet according to claim 21, wherein the copper alloy has a ratio (a/b), between a longer diameter a of a crystal grain on a cross section parallel to a direction of final plastic working, and a longer diameter b of a crystal grain on a cross section perpendicular to the direction of final plastic working, of 1.5 or less.

24. A sheet according to claim 21, wherein the ratio (a/b) is 0.8 or more.

25. A sheet according to claim 21, wherein S is included at a content of less than 0.002% by mass.

26. A sheet according to claim 21, Ag is included at an amount of 0.005 to 0.3% by mass.

27. A sheet according to claim 21, wherein Co is included at an amount of 0.005 to 2.0% by mass.

28. A sheet according to claim 21, wherein Cr is included at an amount of 0.005 to 0.2% by mass.

29. A sheet according to claim 21, wherein the alloy has a tensile strength of 800 N/mm$^2$ or more.

30. A sheet of a copper alloy having a high-mechanical strength, the copper alloy consisting of 1.0 to 4.5% by mass of Ni, 0.2 to 1.0% by mass of Si, 0.01 to 0.20% by mass of Mg, 0.05 to 1.5% by mass of Sn, 0.2 to 1.5% by mass of Zn, and less than 0.005% by mass (including 0% by mass) of 5, optionally 0.01 to 0.5% by mass at a total content of at least one selected from the group consisting of B, Fe, Zr, P. Mn, Ti, V, Pb, Bi and Al, and optionally 0.005 to 2.0% by mass at a total amount of at least one selected from the group consisting of Ag, Co and Cr, with the balance being made of Cu and inevitable impurities, wherein the copper alloy, when the alloy is subjected to an aging treatment, shows a maximum peak of the tensile strength at a peak temperature of 350 to 600° C.; and wherein the alloy is overaged at a between the peak temperature and 50° C. above the peak temperature, wherein the alloy has a stress relaxation ratio of 10% or less when the alloy is maintained at a temperature of 150° C. for a period of 1000 hours.

31. A sheet according to claim 30, wherein a crystal grain of the copper alloy has a diameter from more than 0.001 mm to 0.025 mm.

32. A sheet according to claim 30, wherein the copper alloy has a ratio (a/b), between a longer diameter a of a crystal grain on a cross section parallel to a direction of final plastic working, and a longer diameter b of a crystal grain on a cross section perpendicular to the direction of final plastic working, of 1.5 or less.

33. A sheet according to claim 30, wherein the ratio (a/b) is 0.8 or more.

34. A sheet according to claim 30, wherein S is included at a content of less than 0.002% by mass.

35. A sheet according to claim 30, wherein Ag is included at an amount of 0.005 to 0.3% by mass.

36. A sheet according to claim 30, wherein Co is included at an amount of 0.005 to 2.0% by mass.

37. A sheet according to claim 30, wherein Cr is included at an amount of 0.005 to 0.2% by mass.

38. A sheet according to claim 30, wherein the alloy has a tensile strength of 800 $N/mm^2$ or more.

* * * * *